United States Patent [19]

Crossett

[11] Patent Number: 4,694,514

[45] Date of Patent: Sep. 22, 1987

[54] CONVERTIBLE SOFA MECHANISM

[76] Inventor: Edward H. Crossett, 23333 Ridge Rte., #175, El Toro, Calif. 92630

[21] Appl. No.: 896,012

[22] Filed: Aug. 13, 1986

Related U.S. Application Data

[63] Continuation-in-part of Ser. No. 773,982, Sep. 9, 1985, Pat. No. 4,612,677.

[51] Int. Cl.[4] ..... A47C 17/14

[52] U.S. Cl. ..... 5/12 R; 5/13; 5/18 R; 5/42; 5/66; 297/DIG. 3

[58] Field of Search ..... 5/12 R, 13, 35, 51 E, 5/18 B, 18 R, 17, 24, 47, 63, 66, 42, 51 C, 33, 36, 28, 29, 51 K, 51 M; 297/DIG. 3, DIG. 8

[56] References Cited

U.S. PATENT DOCUMENTS

| | | | |
|---|---|---|---|
| 1,976,753 | 10/1934 | Thomas | 5/12 R |
| 3,747,135 | 7/1973 | Barabas | 5/13 |
| 4,032,999 | 7/1977 | Pringle | 5/18 R |
| 4,074,371 | 2/1978 | Lindbloom | 5/18 R |

*Primary Examiner*—William F. Pate, III
*Assistant Examiner*—R. Chilcot
*Attorney, Agent, or Firm*—Edgar W. Averill, Jr.

[57] ABSTRACT

A three-section convertible sofa mechanism installed in a convertible sofa. The convertible sofa has a pair of curved channels in which the head section of the sofa rides. As the mechanism is pulled outwardly from the sofa frame, the head section is guided upwardly and outwardly by the curved channels. Preferably, the movement of the mechanism in the channels is synchronized so that both sides are raised and lowered together. A retractable leg assembly is also disclosed.

13 Claims, 16 Drawing Figures

FIG. 7.
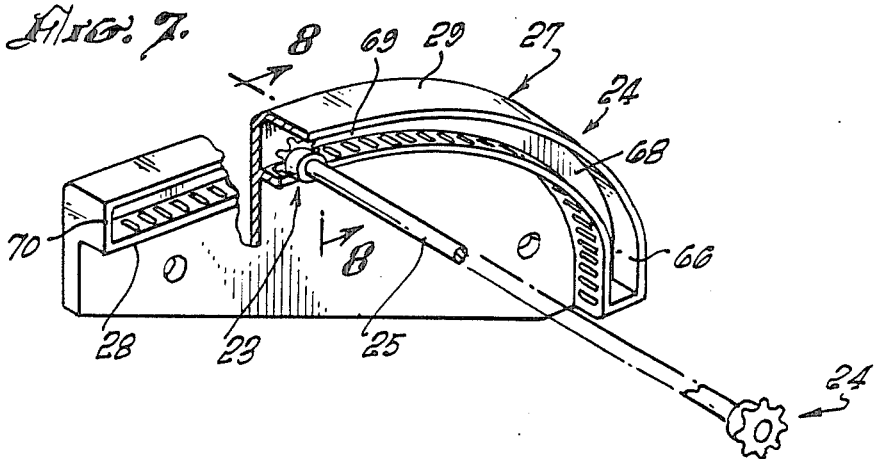
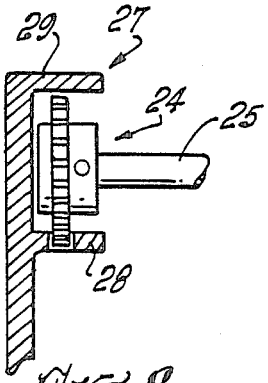
FIG. 8.
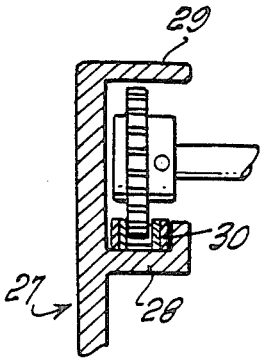
FIG. 9.
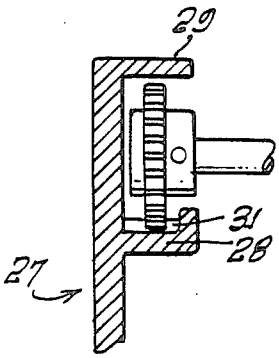
FIG. 10.
FIG. 11.
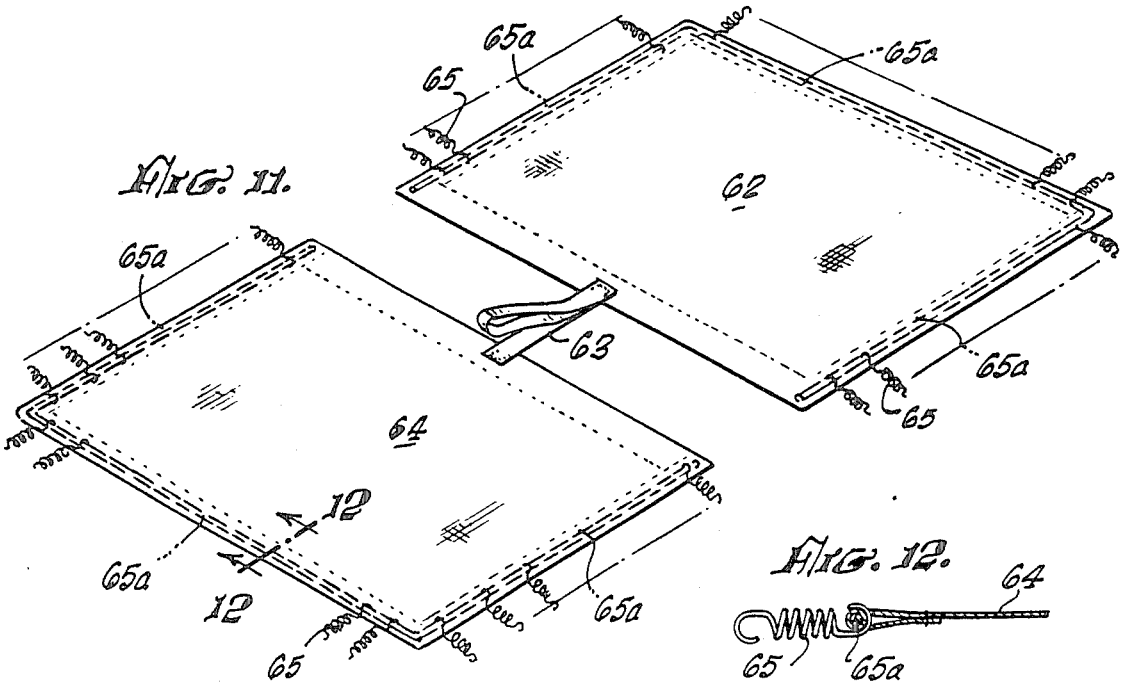
FIG. 12.

16
16

CONVERTIBLE SOFA MECHANISM

CROSS REFERENCE TO RELATED APPLICATIONS

This application is a continuation-in-part of applicant's co-pending application, Ser. No. 773,982 filed Sept. 9, 1985, now U.S. Pat. No. 4,612,677.

BACKGROUND OF THE INVENTION

The field of the invention is furniture and the invention relates more particularly to convertible sofas which are capable of use both as a sofa and a full length bed. Typically, convertible sofas use a foldable mattress which is maintained on the surface of the sections of the bed. As the bed is unfolded, the mattress, too, is unfolded. In order for the mechanism to operate properly, the mattress must be relatively thin and, therefore, deficient in comfort.

One improved convertible sofa mechanism is disclosed in applicant's U.S. Pat. No. 773,982, filed Sept. 9, 1985. This construction utilized a pair of J-shaped channels and used full depth cushions as a mattress. The mechanism also automatically was lifted from the sofa frame by a pair of bellows. Such construction, however, was relatively expensive and a less expensive mechanism utilizing full depth mattress parts would be advantageous.

SUMMARY OF THE INVENTION

It is an object of the present invention to provide a relatively low-cost convertible sofa mechanism having a full depth mattress.

The present invention is for a three-section convertible sofa mechanism installed in a convertible sofa and which may be forwardly extended to a full length bed having a head section, a middle section and a foot section. The convertible sofa has a convertible sofa exterior member having two arms, a back and a front support beam. Right and left curved channels are affixed to the inner surfaces of the arms of the convertible sofa exterior member, and each of the curved channels begins at a lowermost point near the back of the sofa exterior member to their highest point nearer the front of the sofa exterior member. A head section, including a frame having two sides and an inner edge and an outer edge, is supportable near its outer edge by a pair of bearing means affixed to the two sides of the frame. The bearing means is supported by the right and left curved channels and are movable therealong from their inner position where the head section is in its lowermost position to their outermost position when the head section is in its uppermost position. The head section rests on the front support beam when it is in its uppermost position and is supported in about a horizontal position. A middle section is hingedly affixed to the frame of the head section near its outer edge so that the middle section may be pivoted back over the head section when in its folded configuration. A foot section is hingedly affixed to the middle section near its outer edge so that the foot section is movable so that the bottom of the foot section is adjacent to the bottom of the middle section. A pair of legs is affixed near the intersection of the middle section and the foot section. Preferably, the curved channels are curved in a convex manner when viewed from the top of the convertible sofa. Also, preferably, the bearing means are synchronized so that they advance and retract in unison. Two or more retractable legs utilizing a polygonal member may be attached to the foot section of the convertible sofa mechanism.

BRIEF DESCRIPTION OF THE DRAWINGS

FIG. 7 is a perspective view of one of the channels of the mechanism of FIG. 1.

FIG. 8 is an enlarged cross-sectional view taken along line 8—8 of FIG. 7.

FIG. 9 is a cross-sectional view analogous to FIG. 8 of an alternate embodiment of bearing means.

FIG. 10 is a cross-sectional view analogous to FIG. 8 of a modified form of bearing means.

FIG. 11 is a perspective view of the canvas assembly of the mechanism of FIG. 1.

FIG. 12 is a cross-sectional view taken along line 12—12 of FIG. 11.

DESCRIPTION OF THE PREFERRED EMBODIMENTS

Figure 1:
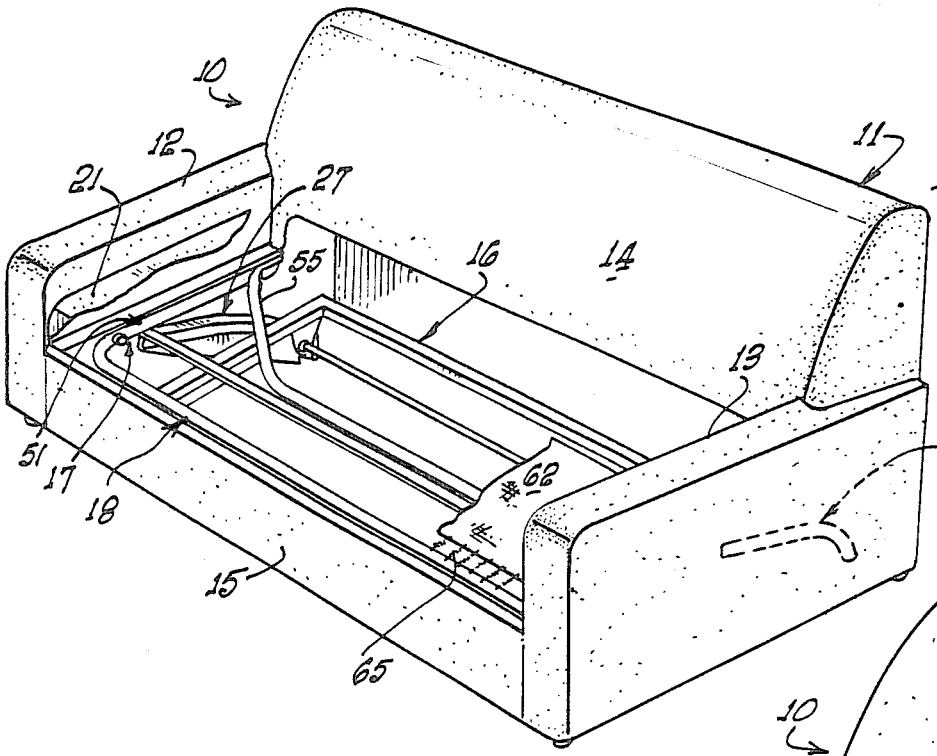
FIG. 1 is a perspective view of the convertible sofa of the present invention.

The convertible sofa is shown in perspective view in FIG. 1 and indicated by reference character 10. Sofa 10 has a sofa frame 11 which has a pair of arms 12 and 13, a back 14 and a front support beam 15. Although the frame members of the convertible bed assembly are spanned with canvas 62, most of the canvas is not shown for purposes of illustration.

Figure 2:
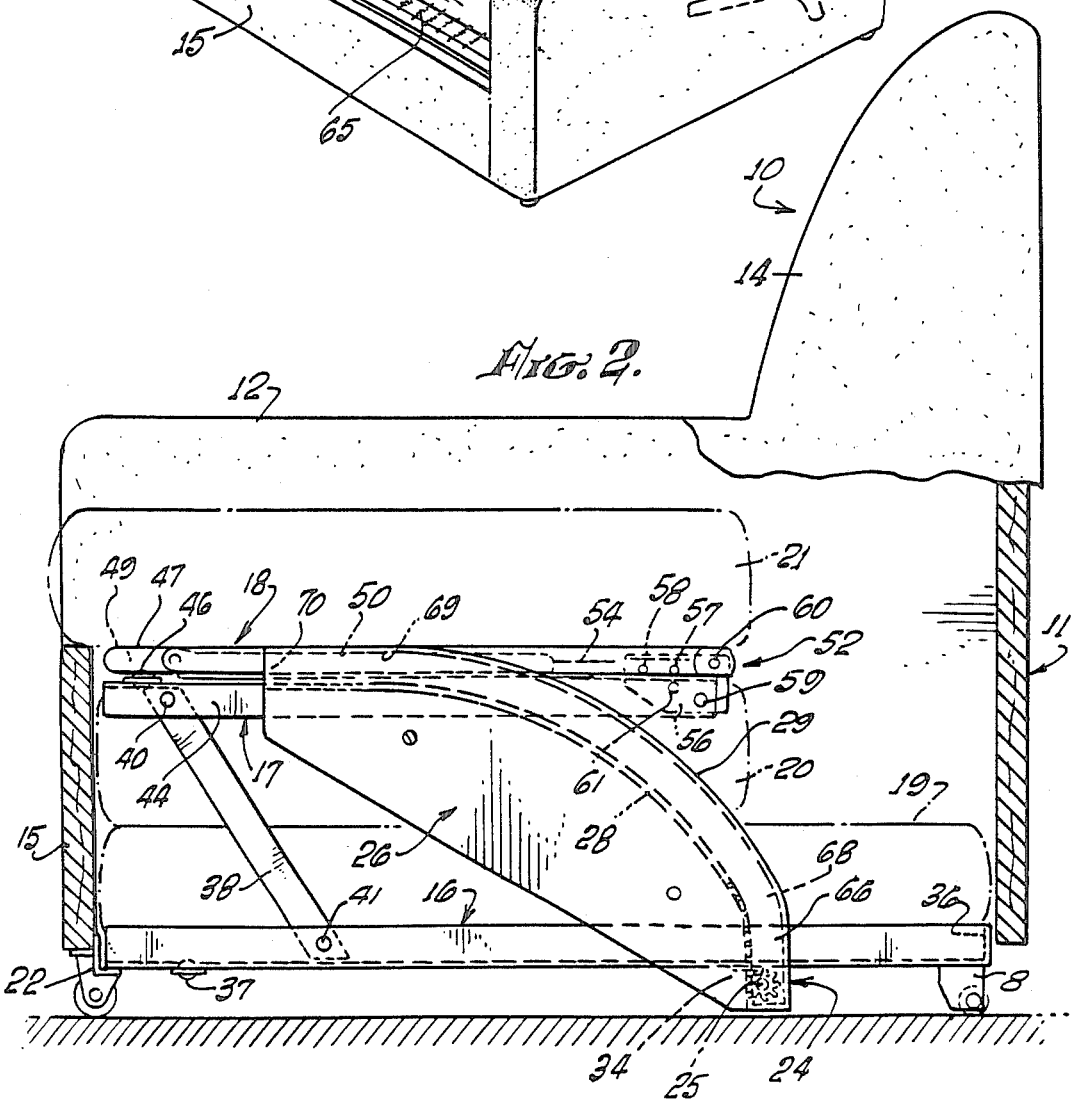
FIG. 2 is a side view thereof.

The convertible sofa is shown in cross-sectional side view in FIG. 2 where it can be seen that the bed mechanism has three sections, namely, a head section 16, a middle section 17 and a foot section 18. Three cushions comprising a head section cushion 19, a middle section cushion 20 and a foot section cushion 21. These cushions may be independent or, preferably, hinged together as indicated in FIG. 2.

The frame of the head section, preferably, rests on two or more arms 22 which are affixed to sofa frame 11 and a pair of wheel assemblies 8 and 9 which rest on the floor and the arm and wheel assemblies hold the head section when it is in its lowermost position. Head section 16 is also supportable by a pair of bearing means 23 and 24 which, as shown in the drawings, comprise a pair of gears shown best in FIG. 8 of the drawings. The use of gears permits the synchronization of the movement of bearing 23 with respect to bearing 24 since the two gears may be connected by a shaft 25 as shown in FIG. 1. The tracks in which bearing means 23 and 24 move are indicated by reference characters 26 and 27, respectively, and the tracks are affixed to the inner surface of arms 13 and 12. Preferably, the tracks include gear teeth meshing means on the lower surface thereof and three forms of such gear teeth meshing means are shown in FIGS. 8, 9 and 10. In FIG. 8, the lower portion 28 of track 27 has a plurality of equally spaced holes in which bearing means 24 rides. The upper portion 29 of track 27 holds the bearing means or gear 24 in the openings of lower portion 28. In FIG. 9, a chain 30 meshes with bearing means or gear 24 in track 27. In FIG. 10, a rack 31 is held along the lower portion 28 and guides gear or bearing means 24 along the lower portion 28 of track 27. Of course, both tracks contain the same gear meshing means so that the shaft 25 keeps bearing means 24 in synchronized position with respect to bearing means 23 so that the head section moves in an aligned manner as it is pulled out of the sofa frame 11. Although bearing means 23 and 24 could merely comprise a skid, the use of a synchronized pair of bearings greatly facilitates the movement of the bed frames.

Figure 3:
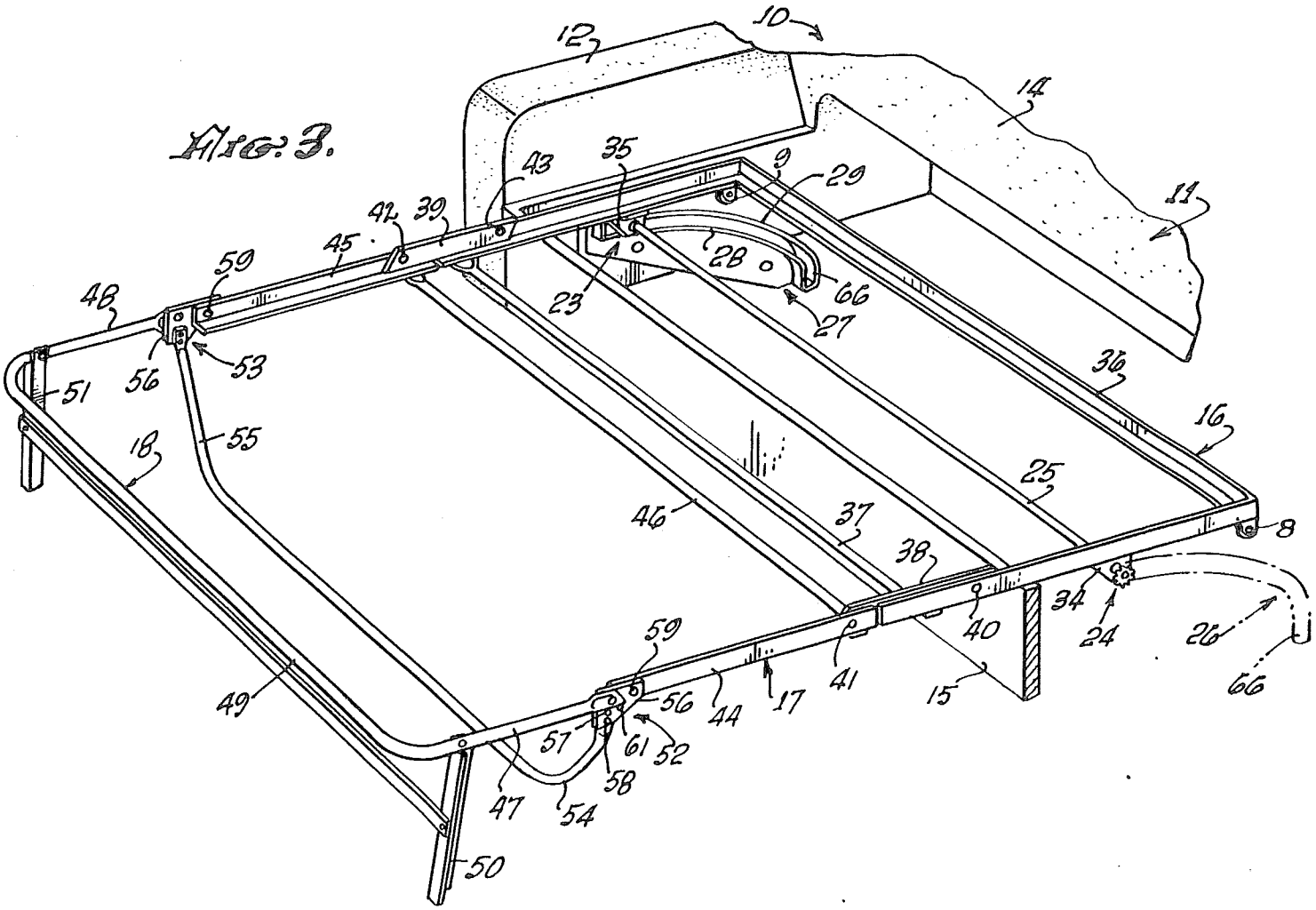
FIG. 3 is a perspective view showing the bed in its unfolded configuration.

Whether held by a shaft, such as shaft 25 (as shown in FIG. 3), or merely a short individual shaft, the bearing means 23 and 24 are connected to the side frame members 32 and 33 by a pair of downwardly extending tabs 34 and 35 which, preferably, would include a bearing to facilitate the turning of bearing means 23 and 24 along tracks 26 and 27.

The bed is shown in extended position in FIG. 3 of the drawings where the inner edge of the head section is identified by reference character 36 and the outer edge 37. Head section 16 is hingedly affixed to middle section 17 by a pair of links 38 and 39. Link 38 has a pair of pins 40 and 41, pin 40 being affixed to side member 44 and pin 41 being affixed to side member 32. Similarly, link 39 is affixed to side member 33 by pin 43 and to side member 45 by pin 42. As shown in FIG. 2, these links hold head section 16 away from middle section 17 to permit the storage of cushions 19 and 20.

Figure 4:
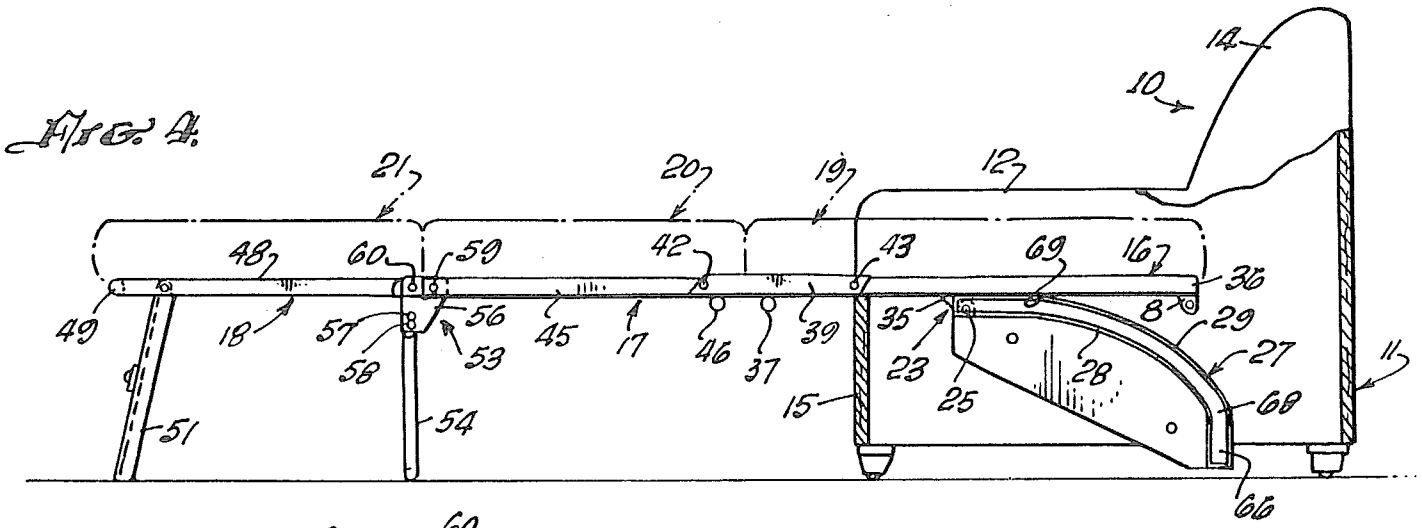
FIG. 4 is a side view showing the bed in its unfolded configuration.
Figure 5:
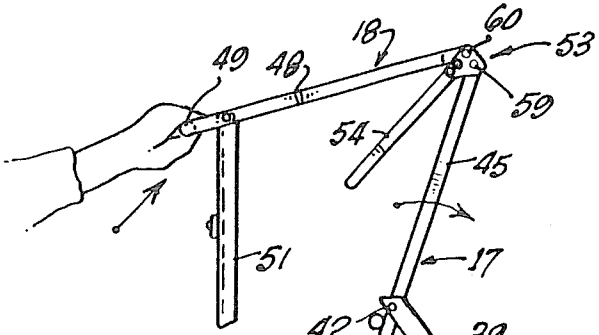
FIG. 5 is a side view showing the bed mechanism in a partially folded configuration.

As seen most clearly by comparing FIGS. 1 and 3, the bed mechanism is pulled out of the sofa frame 11 by lifting on cross member 46 which comprises the inner edge of middle section 17. This raises the outer edge 37 of the head section through links 38 and 39. The inner edge 36 rests on the wheel assemblies 8 and 9 and, thus, as the outer edge 37 is lifted, the bearing means 23 begin to ride upwardly in tracks 26 and 27. After the outer edge has been lifted above the upper surface of front support beam 15, the entire assembly can be pulled outwardly which causes bearing means 23 and 24 to continue to ride upwardly and outwardly along tracks 26 and 27. When bearing means 23 and 24 have reached their outermost position, the head section 16 rests securely on front support beam 15 as shown best in FIG. 4 of the drawings. At this point, head section 16 is about horizontal and in its final bed configuration. Middle section 17 folds about as indicated in FIG. 5 where links 38 and 39 hold the cross member 46 in line with the head section 16. Foot section 18 has side members 47 and 48 and end member 49. Leg means, including legs 50 and 51, are hinged downwardly from side members 47 and 48.

Figure 6:
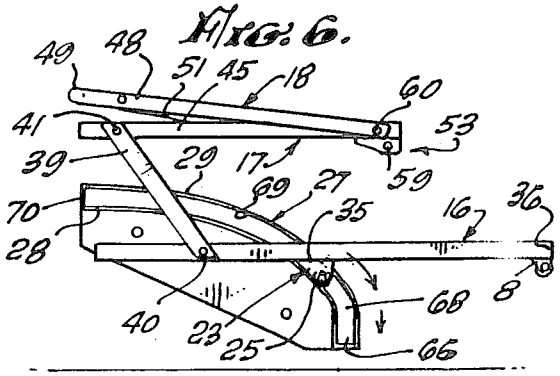
FIG. 6 is a side view showing the bed mechanism retracting to the sofa frame.

A pair of leg assemblies 52 and 53 are hinged so that legs 54 and 55 extend downwardly as the bed is unfolded. As shown best in FIGS. 4, 5 and 6, plate 56 is affixed to leg 54 by a pair of rivets 57 and 58. A pin 59 is affixed to side member 44 of middle section 17 and permits the rotation of plate 56 with respect to side member 44. Similarly, side member 47 of foot section 18 is connected to plate 56 by a pin 60. In this manner, as the foot section is folded against the middle section, as shown in FIG. 5, leg 54 is guided between the two sections. An arm 61 is affixed to plate 56 and urges plate 56 outwardly as foot section 18 is folded outwardly. The result is a secure holding of legs 54 and 55 in a downward position as the bed is in its unfolded configuration.

The bed sections may be covered with a canvas or by a plurality of metal links. A canvas covering is shown in FIG. 11 where canvas sections 62 and 64 are shown held by a plurality of springs 65. The detail of connection of springs 65 with canvas section 64 is shown in FIG. 12 where it can be seen that springs 65 are linked about a rod **65*a* sewn along the edge of canvas section 64**.

The configuration and shape of the channel of track assemblies 26 and 27 forms an important part of the present invention. As shown best in FIG. 2, the track 26 is essentially vertical at its lowermost portion 66. In that way, as the links 38 and 39 are lifted, the bearing means 23 and 24 ride directly upwardly as the inner edge 36 rests on wheel assemblies 8 and 9. Once the outer edge 37 of head section 16 has cleared the upper surface of front beam 15, the bearing means 23 has reached a curved portion 68 of track 26. At this point, the wheel assemblies 8 and 9 rise off the floor and the inner edge 36 moves outwardly and upwardly along a relatively flat portion 69 of track 26. As bearing means 23 reaches the end 70 of track 26, the head section has become about parallel when it rests against the upper surface of support beam 15. Thus, the entire upward and outward movement of the bed sections may be accomplished in a smooth manner particularly if the two bearing means 23 and 24 are synchronized as by shaft 25.

Figures 13, 14, 15, 16:
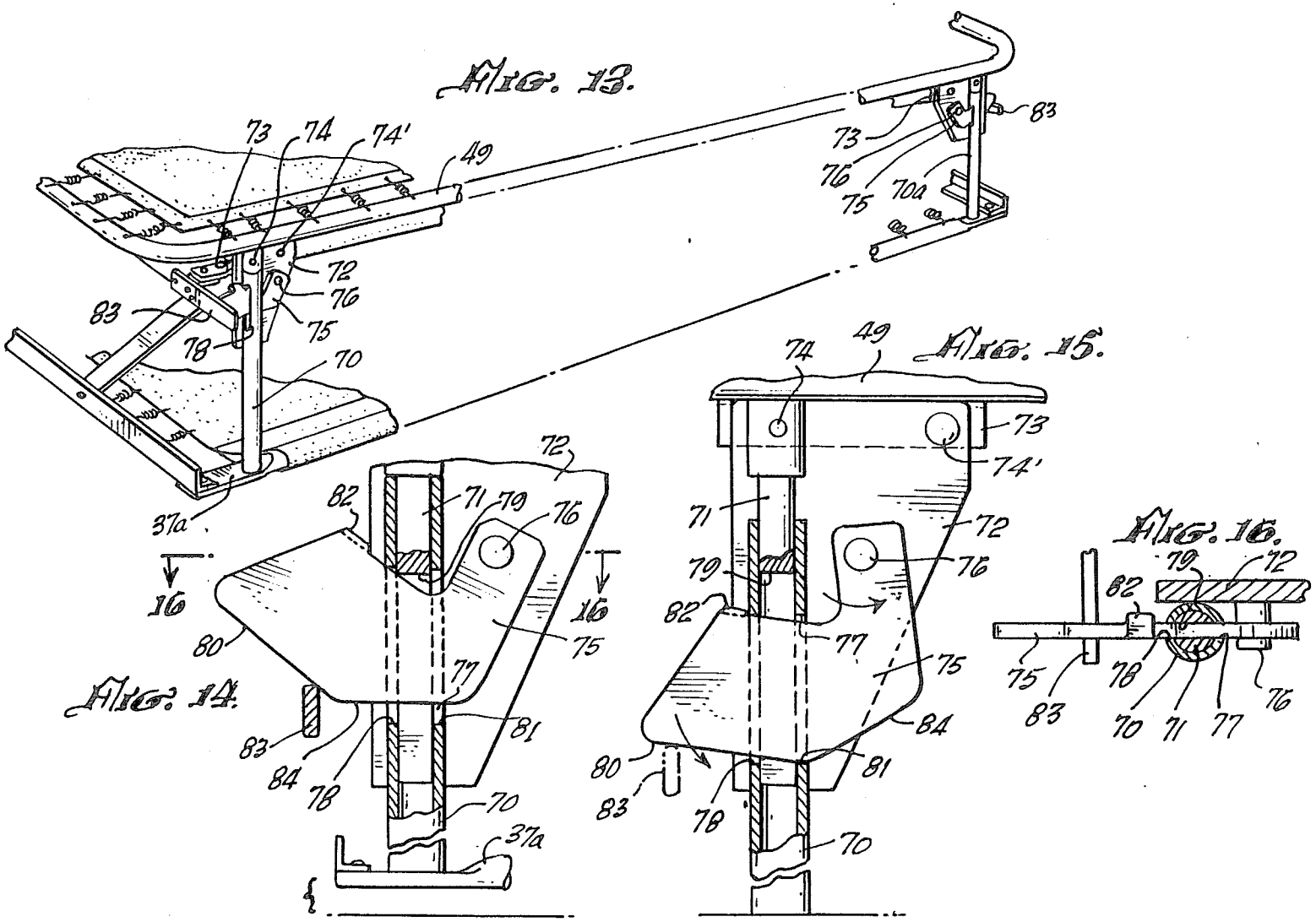
FIG. 13 is a fragmentary perspective view of an alternate configuration of the front end of the convertible sofa of FIG. 1 in a sofa-closed configuration.
FIG. 14 is an enlarged front view of the end leg of the convertible sofa of FIG. 13 in a folded configuration.
FIG. 15 is a front view of the leg of the convertible sofa of FIG. 13 in an extended configuration.
FIG. 16 is a cross-sectional view taken along line 16—16 of FIG. 14.

Although links 38 and 39 are shown between head section 16 and middle section 17, they could alternatively be located between middle section 17 and foot section 18. It is beneficial that the middle section be separated from either the head section or the foot section by a pair of links to permit storage and placement of the cushions. In this manner, a relatively thick mattress may be provided since the mattress, itself, need not fold upon itself in the manner of typical convertible sofa configurations. The convertible sofa of FIG. 13 has an alternate embodiment of front leg assembly 50-51. In FIG. 13, a pair of extendable slotted legs 70 and **70*a* are held by a slotted dowel, such as dowel 71 shown best in FIG. 15. Dowel 71 is held to a bracket 72 which is pinned, or riveted, to a bar 73 fixed to the underside of end member 49. Rivets 74 and 74' hold bracket 72 and dowel 71 securely to bar 73**.

A polygonal wedge 75 is pivotally held to bracket 72 by a pin 76. Polygonal wedge 75 passes through a pair of slots 77 and 78 in leg 70 and also through a slot 79 in slotted dowel 71. Polygonal wedge 75 contacts actuating bar 83 affixed to the end of side member 45 when the convertible sofa is in the position indicated in FIG. 13 where it is folded into the sofa frame. As the mechanism is lifted out of the sofa frame, the polygonal wedge 75 moves downwardly as shown in FIG. 15, and leg 70 extends downwardly and side 80 of polygonal wedge 75 abuts the bottom edge 81 of slot 77. Side 84 clears the bottom edge 81 of slot 77. A tab 82 abuts the leg 70 at the slot 78.

The side 80 functions as a cam surface to cause the leg 70 to release. As the bed is folded, side 80 abuts actuating bar 83 and the polygonal wedge 75 rotates upwardly lifting the leg slightly and allowing the leg to move upwardly as it abuts end member 37*a* as shown in FIG. 14.

The resulting convertible sofa provides exceptional comfort along with great ease of operation. Because of the use of separate, although hingeable cushion/mattress members, an optimum mattress thickness may be accomplished. The lever action of the head section, as its inner edge 36 rests on arms 22, greatly facilitates the raising of the bed. If desired, a coil spring could also be added along shaft 25 to further ease the lifting of the mechanism out of the frame.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A three-section convertible sofa mechanism installed in a convertible sofa and which may be forwardly extended to a full length bed having a head section, a middle section and a foot section, said convertible sofa comprising:

a convertible sofa exterior member having two arms, a back and a front support beam;

right and left curved channels affixed to the inner surfaces of the arms of the convertible sofa exterior member, each of said curved channels beginning at a lowermost point near the back of said sofa exterior member to its highest point nearer the front of the sofa exterior member;

a head section including a frame having two sides and an inner edge and an outer edge, said head section frame being supportable near its outer edge by a pair of bearing means affixed to the two sides of the frame and said bearing means being supported by said right and left curved channels and being movable therealong from its inner position where the head section is in its lowermost position to its outer position when the head section is in its uppermost position and said uppermost point of said curved channel in about a horizontal position;

synchronizing means comprising a rotatable shaft including gear means at each end thereof, said gear means intermeshing with rack means held by said right and left curved channels;

a middle section hingedly affixed to said frame of said head section near its outer edge so that said middle section may be pivoted back over said head section;

a foot section hingedly affixed to said middle section near the outer edge thereof so that the foot section is movable so that the bottom of the foot section is movable to be adjacent to the bottom of the middle section; and a pair of legs near the intersection of the middle section and the foot section.

2. The three-section convertible sofa mechanism of claim 1 wherein said curved channel is curved in a convex manner when viewed from the top of the convertible sofa.

3. The three-section convertible sofa mechanism of claim 2 further including at least two wheel assemblies affixed to the inner edge of the head section which is supported in part by said wheel assemblies when the convertible sofa is in its sofa configuration.

4. The three-section convertible sofa mechanism of claim 3 wherein said curved channel is about vertical at its lower portion and about horizontal at its upper portion.

5. The three-section convertible sofa mechanism of claim 1 wherein said two adjacent sections are connected by a pair of links at least as long as twice the width of a mattress so that after the sections are folded together, two sections of a mattress may be stored between the folded sections.

6. The three-section convertible sofa mechanism of claim 5 wherein said pair of links is affixed between the head and middle sections.

7. The three-section convertible sofa mechanism of claim 1 further including leg means affixed near the outer end of the foot section.

8. The three-section convertible sofa mechanism of claim 1 wherein the bottom of said channels has a plurality of equally spaced openings into which the gear means ride.

9. The three-section convertible sofa mechanism of claim 1 wherein the bottom of said channels has a gear rack thereon on which the gear means ride.

10. The three-section convertible sofa mechanism of claim 1 wherein said rack means comprises a chain on the bottom of said channels on which the gear means ride.

11. The three-section convertible sofa mechanism of claim 1 further including at least two extendable legs affixed to the foot section, each of said legs comprising:

a support bracket affixed to the foot section;

a slotted dowel affixed to the foot section;

a slotted leg telescoped over said slotted dowel, said slotted leg having a pair of slots with an upper terminus and a lower terminus and said slot of said slotted dowel matching the slots of said slotted legs;

a polygonal wedge pivotally held by said support bracket on a first side of said slotted dowel, said polygonal wedge passing through the slots of said slotted leg and the slot of said slotted dowel, said polygonal wedge further having a cam edge along a lower edge thereof protruding through said slot on the second side of said slotted dowel and said polygonal wedge also having a support edge; and an actuating bar affixed to said convertible sofa mechanism and positioned so that it abuts said cam edge when said mechanism is moved into its folded-up or sofa configuration whereby when said polygonal wedge is moved upwardly by the contact of the actuating bar, the support edge is moved out of contact with the lower terminus of said slotted leg.

12. A three-section convertible sofa mechanism installed in a convertible sofa and which may be forwardly extended to a full length bed having a head section, a middle section and a foot section, said convertible sofa comprising:

a convertible sofa exterior member having two arms, a back and a front support beam;

right and left curved channels affixed to the inner surfaces of the arms of the convertible sofa exterior member, each of said curved channels beginning at a lowermost point near the back of said sofa exterior member to its highest point nearer the front of the sofa exterior member;

a head section including a frame having two sides and an inner edge and an outer edge, said head section frame being supportable near its outer edge by a pair of interconnected gear means affixed to the two sides of the frame and said gear means being supported by said right and left curved channels including gear meshing means and being movable therealong from its inner position where the head section is in its lowermost position to its outer position when the head section is in its uppermost position and said head section resting on the front support beam and said uppermost point of said curved channel in about a horizontal position;

at least one support tab affixed to said convertible sofa exterior member and positioned so that the inner edge of the head section is supported by said at least one support tab when it is in its lowermost position;

a middle section hingedly affixed to said frame of said head section near its outer edge so that said middle section may be pivoted back over said head section;

a foot section hingedly affixed to said middle section near the outer edge thereof so that the foot section is movable so that the bottom of the foot section is movable to be adjacent the bottom of the middle section; and a pair of legs near the intersection of the middle section and the foot section.

13. The three-section convertible sofa mechanism of claim 9 wherein said gear means are toothed gears and the toothed gears are interconnected by a shaft.

* * * * *